United States Patent [19]

Wagstaff et al.

[11] Patent Number: 4,947,925

[45] Date of Patent: Aug. 14, 1990

[54] MEANS AND TECHNIQUE FOR FORMING THE CAVITY OF AN OPEN-ENDED MOLD

[75] Inventors: Frank E. Wagstaff, Veradale; David A. Fort, Spokane, both of Wash.

[73] Assignee: Wagstaff Engineering, Inc., Spokane, Wash.

[21] Appl. No.: 314,984

[22] Filed: Feb. 24, 1989

[51] Int. Cl.[5] ..... B22D 11/00

[52] U.S. Cl. ..... 164/459; 164/137; 164/418; 164/341; 164/472; 164/444; 164/486

[58] Field of Search ..... 164/137, 341, 342, 418, 164/459, 443, 444, 485, 486, 472

[56] References Cited

U.S. PATENT DOCUMENTS

| | | | |
|---|---|---|---|
| 2,591,858 | 4/1952 | Ostendorf | 164/342 |
| 3,927,855 | 12/1975 | Kleinhagauer | 164/341 |
| 4,597,432 | 1/1986 | Collins et al. | 164/444 |
| 4,598,763 | 7/1986 | Wagstaff et al. | 164/444 |
| 4,693,298 | 9/1987 | Wagstaff | 164/486 |
| 4,709,744 | 12/1987 | Bayson et al. | 164/444 |
| 4,723,591 | 2/1988 | Vives et al. | 164/418 |

*Primary Examiner*—Richard K. Seidel

*Attorney, Agent, or Firm*—Christopher Duffy

[57] ABSTRACT

The mold is equipped with a casting ring 6 which is formed by clamping together four generally rectilinear wall segments 8 that are, first, arranged like the sides of a picture frame about the rabbet 52 of a rectangular case 10, and then abutted together, sash-like, at their mitered ends 80, to form a ring, the casting surface 9 of which will produce the rectangular cross-sectional outline common to sheet ingot or the like, when molten metal is fed through the ring. The clamping action is produced by a set of screws 94 at the corners 10' of the case, and after the ring 6 is clamped about a pair of spaced, axially opposing lips 54 and 60 on the case and an annular plate 14 thereabove, the plate 14 is clamped to the top of the case, to secure the ring in place and seal the axial ends of the ring against fluid flow thereacross.

95 Claims, 6 Drawing Sheets

Fig. 4
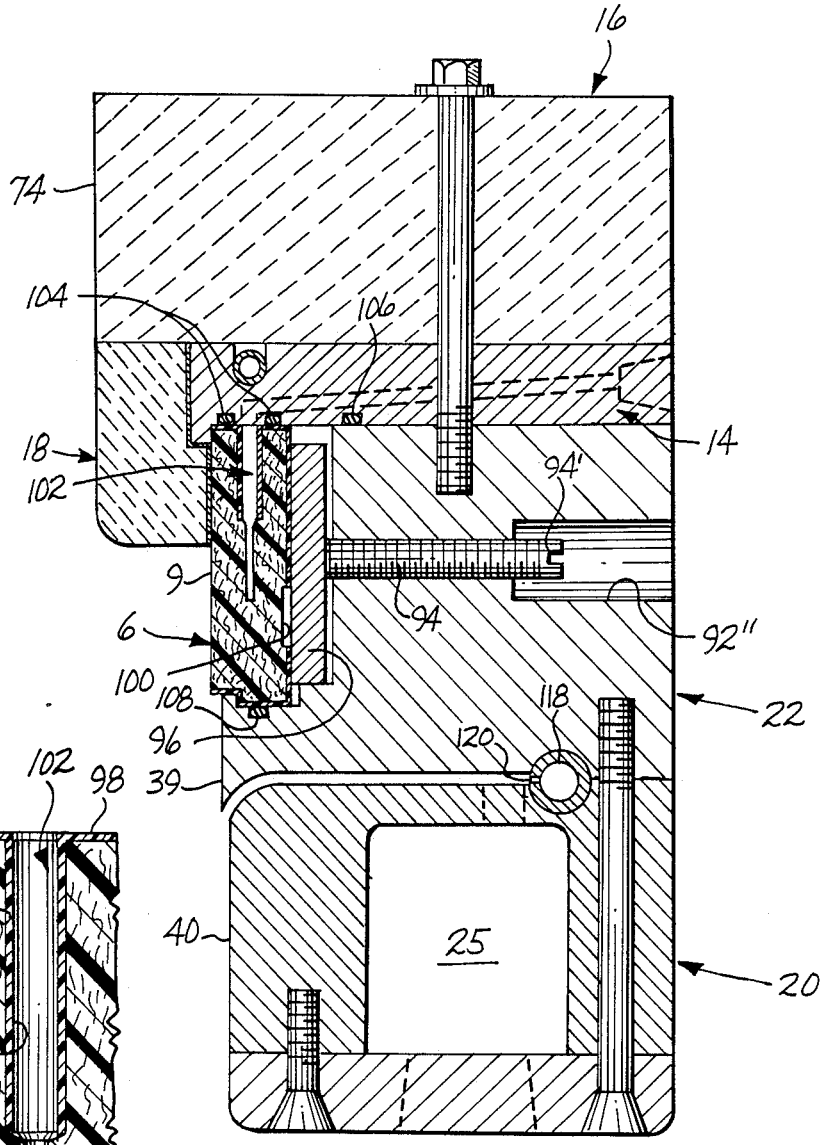
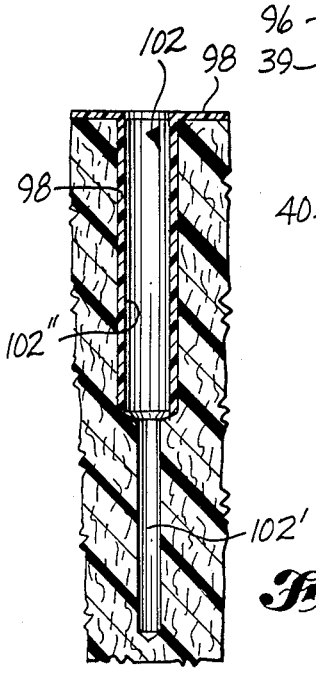
Fig. 3

MEANS AND TECHNIQUE FOR FORMING THE CAVITY OF AN OPEN-ENDED MOLD

TECHNICAL FIELD

This invention relates to a means and technique for forming the cavity of an open-ended mold which is to be used in casting metal by the step of feeding the metal in molten condition through the mold along an axis extending between the end openings thereof; and more particularly, to a means and technique of this nature whereby in forming the cavity of the mold, a casting ring can be invested so fluid-tightly in the peripheral wall of the cavity that, if desired, the ring can be constructed from a fluid-permeable material and fluid can be forced through the ring to form an annulus of the same in the cavity in the manner described in U.S. Pat. No. 4,598,763, notwithstanding that the outer peripheral face of the ring is not fluid-tight with the wall. The invention is especially applicable to the formation of a cavity having an angulated cross-sectional outline at the peripheral wall thereof, such as the rectangular cross-sectional outline employed in casting sheet ingot; and the outline may be formed by a casting ring which is fluid-permeable so that the process of U.S. Pat. No. 4,598,763 can be employed in casting the metal. Moreover, that process may be supplemented, if desired, by the casting process disclosed in U.S. Pat. No. 4,693,298. Both patents are incorporated by reference herein.

BACKGROUND ART

In U.S. Pat. No. 4,598,763, a fluid-permeable casting ring was invested in the peripheral wall of the mold cavity, and was used to envelope the body of molten metal in an oil-encompassed annulus or "sleeve" of gas that assisted the body in escaping from the mold without galling. The patented sleeve-forming process is now widely used in casting aluminum, in particular, because of the superior surface qualities it provides, and the process is often supplemented by the gas-infused direct chill process disclosed in U.S. Pat. No. 4,693,298, which enhances the effects obtained by the sleeve-forming process.

To employ the sleeve-forming process, however, the casting ring must be invested so fluid-tightly in the peripheral wall of the cavity, that the fluid delivery system for the ring can introduce the gas and oil to the body of the ring without risk that the fluids will intermix with one another other than in the body of the ring as intended, and without risk that they will escape from the mold other than at the inner peripheral surface or "casting surface" of the ring, where the annulus or "sleeve" is formed. In short, the ring must be incorporated in the mold in such fluid-tight relationship with the same that the fluids can be introduced to the ring at certain strategic locations thereon which will assure that the fluids function as intended, yet the fluid-tight relationship between the ring and the mold will prevent the fluids from escaping other than at the casting surface of the ring.

A common technique for this purpose has been to machine the ring to the desired diameter on a lathe, and then while the ring is seated on a support in the peripheral wall of the cavity, to heat-shrink the mold around the ring in an oven, to produce an essentially fluid-tight relationship between the ring and the wall of the cavity at the outer peripheral face of the ring, due to the hoop-tension generated in the mold at the face of the ring.

Given this "shrink-fit" around the ring, the fluids can be introduced then at separate points on the outer peripheral face of the ring and one axial end thereof, and can be expected to intermix with one another only as intended in the body of the ring, and to escape only at the casting surface of the ring.

The technique is limited, however, to the formation of a cavity having a cylindrical cross-sectional outline at the peripheral wall thereof. It cannot be used to confer an angulated cross-sectional outline on the cavity, and even when the technique is used to confer a cylindrical cross-sectional outline on the cavity, the larger cylindrical sizes often call for raw material sizes, oven sizes, and machining techniques which are outside of the standards of everyday practice used in the moldmaking industry.

DISCLOSURE OF THE INVENTION

The present invention provides a means and technique whereby in the formation of the mold cavity, a casting ring can be invested so fluid-tightly in the peripheral wall of the cavity that, if desired, the ring can be constructed from fluid-permeable material and fluid can be forced through the ring to form an annulus or "sleeve" of the same in the cavity, notwithstanding that the outer peripheral face of the ring is not fluid-tight with the wall. According to the invention, the casting ring is arranged about the axis of the mold at a point between the end openings thereof, and then clamped between a pair of annular casing members which are relatively reciprocably arranged about the axis to form an annular joint between the respective end openings of the mold, and are inter-engageable with the axial ends of the ring to define the cavity at the inner peripheral surface of the joint when the casing members are reciprocated relatively toward one another to form the joint. In this way, a fluid-tight relationship is developed between the ring and the mold at the axial ends of the ring, and notwithstanding that none may be developed between the mold and the outer peripheral face of the ring, gas and oil can be introduced at separate points on the outer peripheral face of the ring and one axial end thereof, in such a way that they intermix with one another only in the body of the ring, and escape from the mold only at the casting surface of the ring.

In many of the presently preferred embodiments of the invention, the casting ring is arranged on an annular support between the casing members. In some embodiments, the support is formed by a recess in one of the casing members; and in certain embodiments, the support has an annular lip about the inner periphery thereof, and the casting ring is arranged on the support about the lip.

In one group of embodiments, the casing members have an annular recess therebetween, the recess has a pair of spaced, axially-opposing lips at the inner periphery thereof, and the casting ring is arranged in the recess about the lips, to be clamped therebetween.

Where the molten metal is fed along the axis from one end opening of the mold to the other, the aperture in the casing member adjacent the one end opening of the mold, may have a diameter smaller than the diameter of the aperture in the ring, so that the inner peripheral edge of the aperture in the one casing member forms an overhang for a hot top, relatively over the inner peripheral surface of the ring.

Moreover, where the molten metal is to be fed along the axis from one end opening of the mold to the other, the casing member adjacent the aforesaid one end opening of the mold may be cooled by introducing liquid coolant into the same at one pair of opposing sides thereof, and discharging the coolant at another pair of opposing sides thereof, so as to balance the cooling effect between each pair of sides. The other casing member is preferably cooled by introducing liquid coolant into the same and discharging the coolant from the other casing member onto the body of metal as the body emerges from the other end opening of the mold. Bubbles of insoluble gas may be infused into the coolant before it is discharged onto the metal body, in the manner of the process described in U.S. Pat. No. 4,693,298.

Where the body of the casting ring is fluid-permeable and fluid delivery means are provided for forcing a fluid through the body of the ring for discharge into the cavity at the inner periphery of the ring, a layer of fluid-sealant material is preferably interposed between each of the axial ends of the ring and the adjacent casing member. In addition, the fluid delivery means are preferably adapted to force the fluid into the casting ring at an annular surface about the outer peripheral face of the ring, and a layer of fluid-sealant material is formed on the outer peripheral face of the ring between the aforesaid surface and each of the axial ends of the ring.

Where second fluid delivery means are provided for forcing a second fluid through the body of the ring for discharge into the cavity with the first mentioned fluid at the inner periphery of the ring, the second fluid delivery means are preferably adapted to force the second fluid into the ring at a series of circumferentially spaced ports formed in the body of the ring and opening through the layer of fluid-sealant material at one axial end of the ring.

In a special group of embodiments, the casting ring comprises a plurality of individually discrete pieces which interconnect with one another to form the ring. The pieces are arranged in a plane perpendicular to the axis of the mold, and clamped together within the ambit of a set of clamping devices that are arranged about the pieces and relatively reciprocable in the plane of the ring. In many of the presently preferred embodiments of this group, the pieces are arranged on an annular support between the casing members, and the clamping devices are applied to the plurality of pieces from the body of one of the casing members. In some embodiments, the support is formed by a recess in the one casing member; and in certain embodiments, the support has an annular lip about the inner periphery thereof, and the pieces of the ring are clamped about the lip when they are interconnected with one another to form the ring. Sometimes, the casing members have an annular recess therebetween, the recess has a pair of spaced, axially-opposing lips at the inner periphery thereof, and the pieces of the ring are arranged in the recess and clamped about the lips, in the space therebetween, when the pieces are interconnected with one another to form the ring.

In some embodiments, the pieces are arranged to have relatively adjacent ends in the plane of the ring, and the clamping devices are applied to the plurality of pieces to abut them with one another at their relatively adjacent ends. In certain embodiments, the relatively adjacent ends of the pieces are mitered, and the clamping devices re applied to the pieces at the joints between the relatively adjacent ends thereof, and along the planes of the joints, relatively radially inwardly of the aperture of the ring.

In one special set of embodiments, the pieces of the ring form an aperture having an angulated cross-sectional outline at the inner peripheral surface of the ring. In certain of them, the pieces are four in number, individually elongated, and generally rectilinear in length, so that they form an aperture, the cross-sectional outline of which has a quadrilateral configuration at the inner peripheral surface of the ring.

In a structural sense, the means for forming the cavity of the mold comprise a pair of annular casing members which are relatively reciprocably arranged about the axis of the mold to form an annular joint between the respective end openings of the mold, and a casting ring which is arranged about the axis between the casing members and clampable between the casing members at the axial ends thereof to form the cavity at the inner peripheral surface of the joint when the casing members are reciprocated relatively toward one another to form the joint.

As indicated earlier, the casting ring is often arranged on an annular support between the casing members. In some embodiments, the support is formed by a recess in one of the casing members; and in certain embodiments, the support has an annular lip about the inner periphery thereof, and the casting ring is arranged on the support about the lip.

In one group of embodiments, the casing members have an annular recess therebetween, the recess has a pair of spaced, axially-opposing lips at the inner periphery thereof, and the casting ring is arranged in the recess about the lips, to be clamped therebetween.

Where the molten metal is to be fed along the axis from one end opening of the mold to the other, the aperture in the casing member adjacent the aforesaid one end opening of the mold may have a diameter smaller than the diameter of the aperture in the ring, so that the inner peripheral edge of the aperture in the one casing member forms an overhang for a hot top, relatively over the inner peripheral surface of the ring.

Moreover, where the molten metal is to be fed along the axis from one end opening of the mold to the other, the casing member adjacent the aforesaid one end opening of the mold may have means therein whereby liquid coolant can be introduced into the same at one pair of opposing sides thereof, and discharged at another pair of opposing sides thereof, so as to balance the cooling effect between each pair of sides. Meanwhile, the casing member adjacent the aforesaid other end opening of the mold may have means therein whereby liquid coolant can be introduced to the same and discharged from the respective casing member onto the body of metal as the body emerges from the other end opening of the mold. Preferably, means are also provided for infusing bubbles of insoluble gas into the coolant before it is discharged onto the metal body.

Where the body of the casting ring is fluid-permeable, and fluid delivery means are provided for forcing a fluid through the body of the ring for discharge into the cavity at the inner periphery of the ring, a layer of fluid-sealant material is preferably interposed between each of the axial ends of the ring and the adjacent casing member. In addition, the fluid delivery means are commonly adapted to force the fluid into the casting ring at an annular surface about the outer peripheral face of the ring, and the ring has a layer of fluid-sealant material formed on the outer peripheral surface thereof, between the surface and each of the axial ends of the ring.

The ring may also have a series of circumferentially-spaced ports in the body thereof, which open through the layer of fluid-sealant material at one axial end of the ring, and second fluid delivery means may be provided for forcing a second fluid through the body of the ring, at the ports, for discharge into the cavity with the first mentioned fluid at the inner periphery of the ring.

Once again, the casting ring may comprise a plurality of individually discrete pieces which interconnect with one another to form the ring, and the pieces may be arranged in a plane perpendicular to the axis of the mold, and accompanied by a set of clamping devices which are arranged about the pieces and relatively reciprocable in the plane of the ring to clamp the pieces together within the ambit thereof. The pieces are commonly arranged on an annular support between the casing members, as indicated earlier, and the clamping devices are applied to the plurality of pieces from the body of one of the casing members. In some embodiments, the support is formed by a recess in the one casing member, and in certain embodiments, the support has a an annular lip about the inner periphery thereof, and the pieces of the ring are clamped about the lip when they are interconnected with one another to form the ring. Sometimes, the casing members have an annular recess therebetween, the recess has a pair of spaced, axially-opposing lips at the inner periphery thereof, and the pieces of the ring are arranged in the recess and clamped about the lips in the space therebetween, when the pieces are interconnected with one another to form the ring.

In some embodiments, the pieces are arranged to have relatively adjacent ends in the plane of the ring, and the clamping devices are applied to the plurality of pieces to abut them with one another at their relatively adjacent ends. In certain embodiments, the relatively adjacent ends of the pieces are mitered, and the clamping devices are applied to the pieces at the joints between the relatively adjacent ends thereof, and along the planes of the joints, relatively radially inwardly of the aperture of the ring.

As mentioned, in one special set of embodiments, the pieces of the ring form an aperture having an angulated cross-sectional outline at the inner peripheral surface of the ring. In certain of them, the pieces are four in number, individually elongated, and generally rectilinear in length, so that they form an aperture, the cross-sectional outline of which has a quadrilateral configuration at the inner peripheral surface of the ring.

The invention also provides a casting ring for use in forming the cavity of an open-ended mold which is to be used in casting metal ingot of angulated cross-sectional outline. According to the invention, the casting ring comprises a plurality of co-planar, but individually discrete pieces of wall-defining material, which are arranged to have relatively adjacent ends in the plane thereof, and to abut one another at their relatively adjacent ends to form a ring, the aperture of which has an angulated cross-sectional outline at the inner peripheral surface of the ring. For example, to form sheet ingot or the like, the pieces are often four in number, individually elongated, and generally rectilinear in length, so that they form an aperture, the cross-sectional outline of which has a quadrilateral configuration at the inner peripheral surface of the ring.

Where a fluid is to be employed, the bodies of the pieces are commonly fluid-permeable and adapted so that when abutted together to form the ring, the ring has an annular slot about the outer peripheral face thereof, a series of circumferentially-spaced holes in one axial end thereof, and a layer of fluid-sealant material on the outer peripheral face thereof and the respective axial ends thereof, with the exception of the slot and the holes. In addition, layers of fluid-sealant material may be interposed between the pieces at the joints therebetween.

Additionally, the invention provides a wall-defining member for use in forming a casting ring that is to be used in forming the cavity of an open-ended mold to be used in casting metal ingot of angulated cross-sectional outline. According to the invention, the wall-defining member comprises an elongated piece of wall-defining material which is generally rectilinear in length and quadrilateral in cross-section, and which has ends that are mitered relatively toward one another, in the direction of one longitudinally-extending side of the piece. In that instance where fluid is to be employed, the body of the piece is fluid-permeable and has a slot along the length of the side thereof opposed to the aforesaid one longitudinally-extending side thereof. The body of the piece also has a series of longitudinally-spaced holes in one of the remaining longitudinally-extending sides thereof, and a layer of fluid-sealant material on each of the longitudinally-extending sides thereof, with the exception of the surfaces of the slot and the holes, and a portion of the surface of the aforesaid one longitudinally-extending side thereof.

In some embodiments, the holes are counterbored and the counterbores of the same also have a layer of fluid-sealant material thereon.

Moreover, in certain embodiments, the body of the piece has a bow in the length of the same, relatively toward the side thereof opposed to the aforesaid one longitudinally-extending side thereof.

In a related way, the invention also provides a means and technique for configuring the cross-sectional area of the cavity at the peripheral wall thereof, when the cavity is being formed in the mold. According to the invention, a casting ring is arranged about the axis of the mold at a point between the end openings thereof, and the ring is clamped within a pair of annular clamping devices at the peripheral wall of the cavity, to secure the ring axially and transversely thereof, respectively. In many of the presently preferred embodiments of the invention, one clamping device is applied about the outer peripheral face of the ring while it is disposed on an annular support adjacent the peripheral wall of the cavity, and the other clamping device is applied to the axial ends of the ring while it is secured within the one clamping device. In some embodiments, the clamping devices are applied to the ring while it is disposed in an annular recess at the peripheral wall of the cavity. And in certain of them, the annular recess is defined by the aforesaid other clamping device.

To illustrate, in one group of embodiments, the mold comprises a pair of annular casing members which are relatively reciprocably arranged about the axis to form an annular joint between the respective end openings of the mold, and the casting ring is clamped between the casing members at the inner peripheral surface of the joint when the casting ring has been clamped within the one clamping device and the casing members have been reciprocated relatively toward one another to form the joint. In some embodiments, the casing members have an annular recess therebetween, the recess has a pair of spaced, axially-opposing lips at the inner periphery thereof, and the casting ring is arranged in the recess about the lips and clamped therebetween.

As before, the ring may comprise a plurality of individually discrete pieces which interconnect with one another to form the ring. In such a case, the pieces are commonly arranged in a plane perpendicular to the axis of the mold, and clamped together within the ambit of one clamping device, before the ring is clamped within the other clamping device, axially of the cavity.

Also, once again, the pieces of the ring may form an aperture having an angulated cross-sectional outline at the inner peripheral surface of the ring; and the body of the casting ring may be fluid-permeable, and fluid delivery means may be provided for forcing a fluid through the body of the ring for discharge into the cavity at the inner periphery of the ring.

In a structural sense, the means for configuring the cross-sectional area of the cavity at the peripheral wall thereof, comprise a casting ring arranged about the axis of the mold at a point between the end openings thereof, and a pair of annular clamping devices at the peripheral wall of the cavity, having the ring clamped therewithin to secure the ring axially and transversely of the cavity, respectively.

In addition to forming the cavity and/or configuring the cross-sectional area of the cavity at the peripheral wall thereof, the invention also provides a means and technique for casting metal ingot of angulated cross-sectional outline in an open-ended mold cavity having a peripheral wall formed about an axis extending between the end openings thereof. According to the invention, a plurality of individually discrete wall-defining members is arranged adjacent the peripheral wall of the cavity, and the wall-defining members are interconnected with one another to form a casting ring, the aperture of which has an angulated cross-sectional outline at the inner peripheral surface of the ring. The ring is then secured about the axis in a plane perpendicular thereto, so that when the molten metal transmigrates through the cavity along the axis, the ring confers an angulated cross-sectional outline on the molten metal mass corresponding to that at the inner peripheral surface of the ring. In many of the presently preferred embodiments of the invention, the wall-defining members are interconnected with one another by clamping them together on an annular support formed in the plane about the axis adjacent the peripheral wall of the cavity; and in some, an annular lip is formed about the support at the inner periphery thereof, and the wall-defining members are arranged about the lip and clamped together so as to seize the lip as they come together to form the ring.

In certain embodiments of the invention, as mentioned earlier, the mold comprises a pair of casing members which are clamped together about the axis to define the cavity, and the ring is clamped between the casing members at an annular recess defined therebetween.

Once again, the bodies of the wall-defining members may be fluid-permeable, and fluid delivery means may be provided for forcing the fluid through the body of the ring for discharge into the cavity at the inner periphery of the ring.

In a structural sense, the casting mold comprises a plurality of individually discrete wall-defining members which are arranged adjacent the peripheral wall of the cavity and accompanied by means for interconnecting them with one another to form a casting ring, the aperture of which has an angulated cross-sectional outline at the inner peripheral surface of the ring. The members and the means for interconnecting them with one another, are accompanied in turn by means for securing the ring about the axis in a plane perpendicular thereto, so that when molten metal is fed through the cavity along the axis, the ring confers an angulated cross-sectional outline on the molten metal mass corresponding to that at the inner peripheral surface of the ring.

In a related way and in addition to all of the foregoing, the invention also provides a particular type of mold for the purposes of the various means and techniques discussed. According to the invention, the mold comprises a case which is arranged about the axis of the mold and has a generally rectangular opening in the body thereof, and an annular rabbet about the peripheral edge of the opening at one axial end thereof. The case is accompanied by a plurality of relatively reciprocable clamping elements which are arranged about the rabbet on the body of the case, to apply clamping forces transverse the opening, in the plane of the rabbet, so that a ring can be clamped, sash-like, substantially within the rabbet to form the casting surface of the mold at the case.

BRIEF DESCRIPTION OF THE DRAWINGS

These features will be better understood by reference to the accompanying drawings which illustrate a presently preferred embodiment of the invention wherein an open-ended mold is provided that is equipped with a multi-piece casting ring, so as to be adapted to cast metal ingot in sheet form, that is, with a substantially rectangular cross-sectional outline transverse the longitudinal axis thereof, and to do so with the processes disclosed in U.S. Pat. Nos. 4,598,763 and 4,693,298.

In the drawings:

FIG. 3 is an enlarged part cross-sectional view of an oil feed hole in one piece of the casting ring;

FIG. 4 is a part cross-sectional view of the mold along an thereof coinciding with one corner of the mold;

BEST MODE FOR CARRYING OUT THE INVENTION

Figure 1:
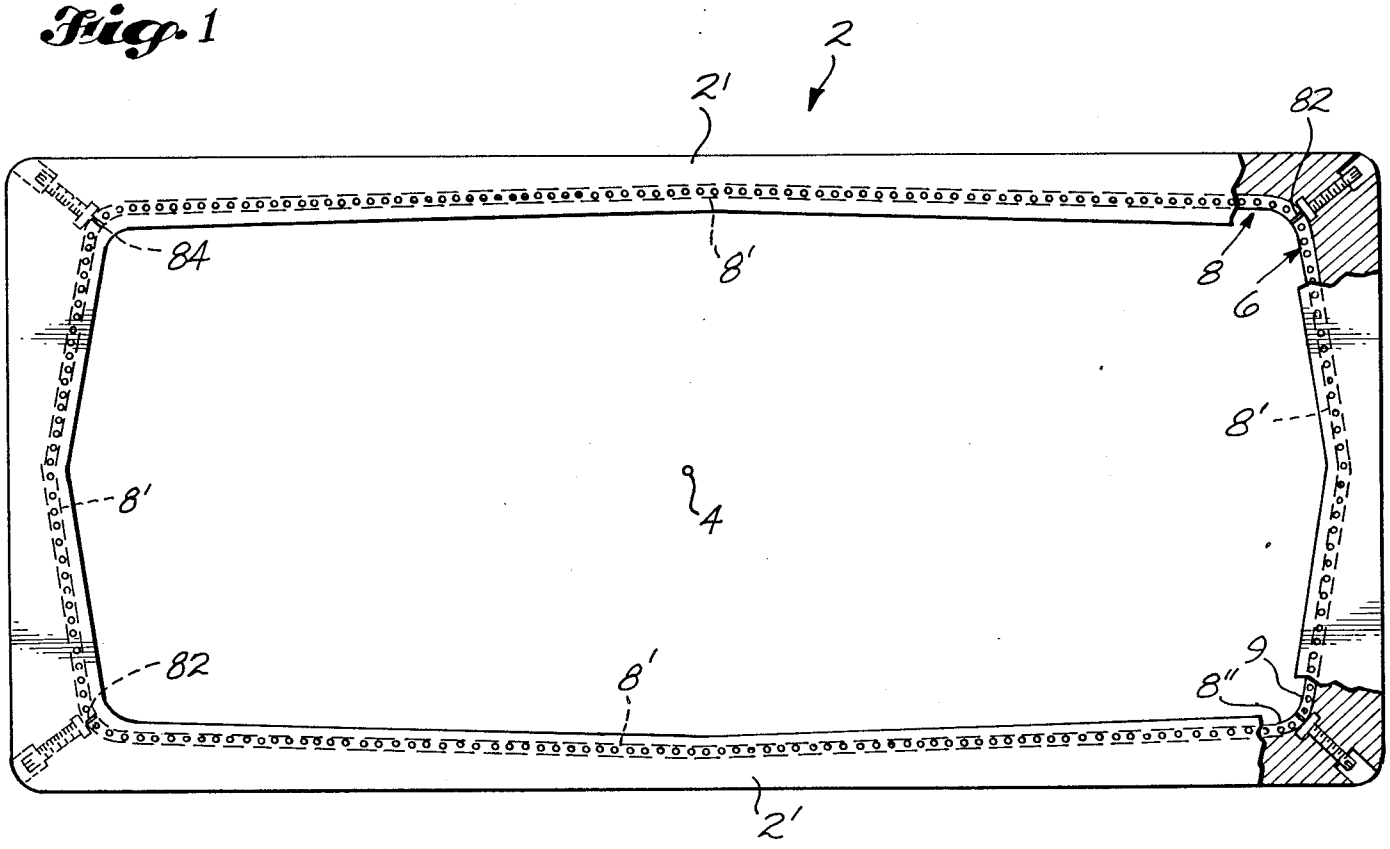
FIG. 1 an axial view of the mold at the top thereof.
Figure 2:
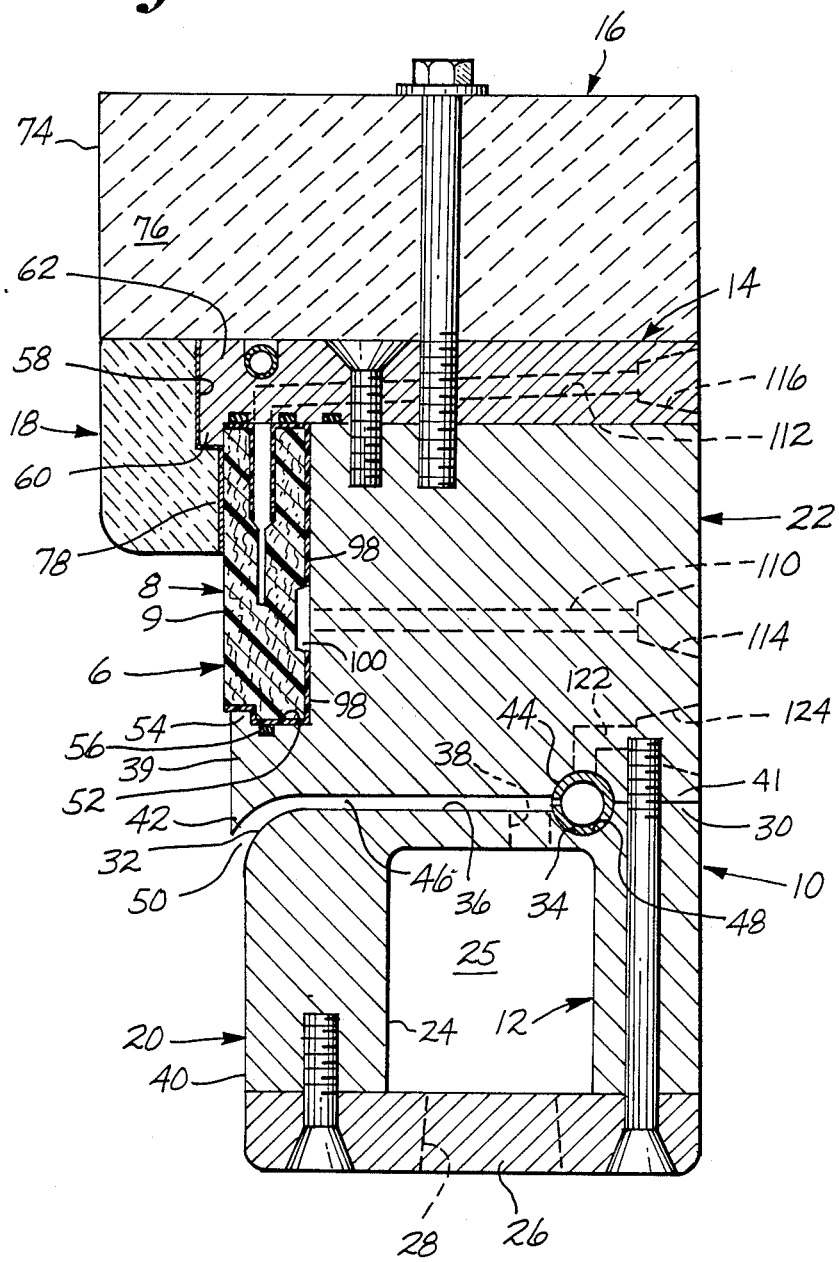
FIG. 2 a part cross-sectional view of the mold along an axial plane thereof extending midway between adjacent corners of the mold.
Figure 5:
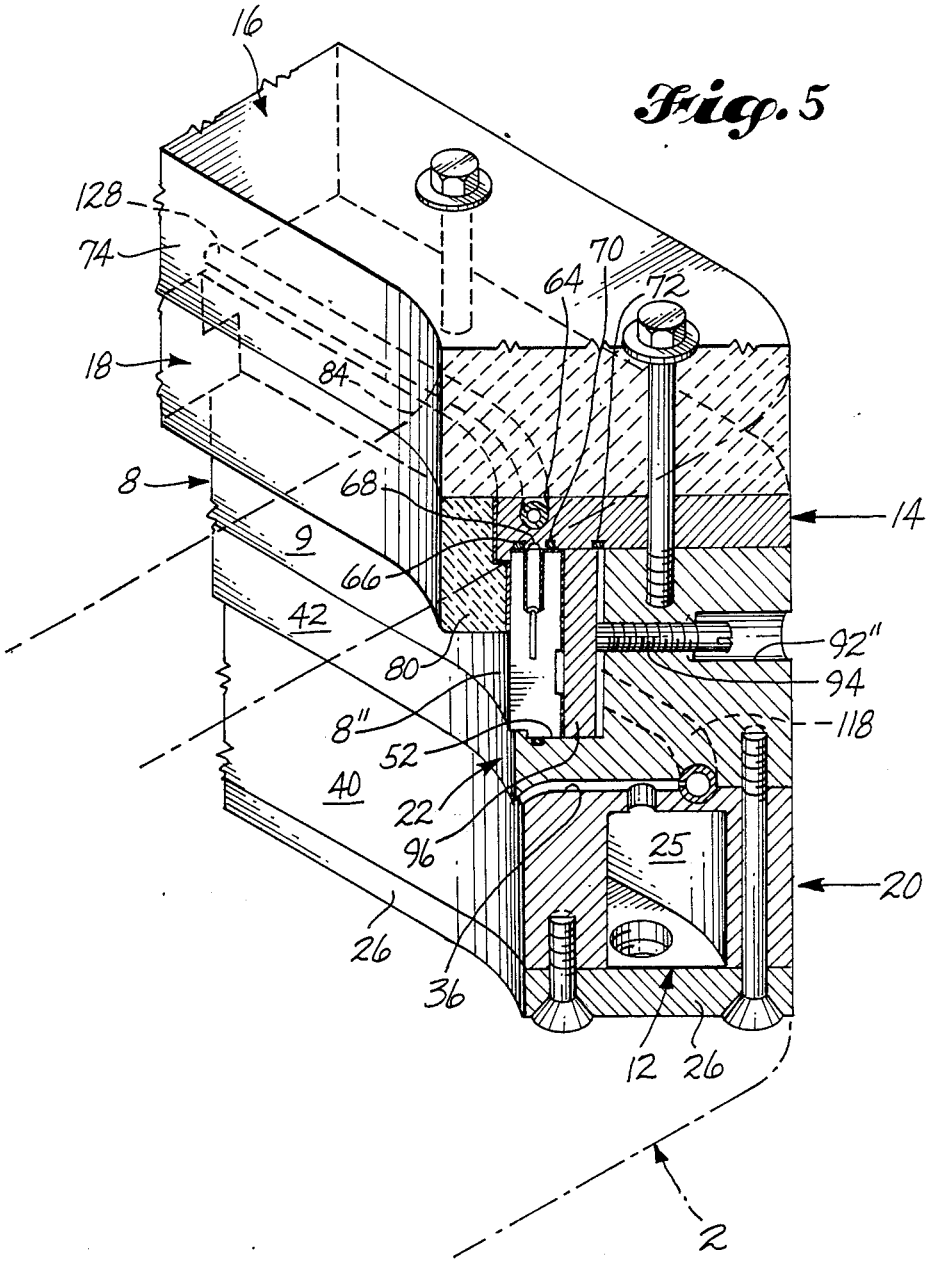
FIG. 5 is a part perspective view of the corner in axial plane of FIG. 4.
Figure 7:
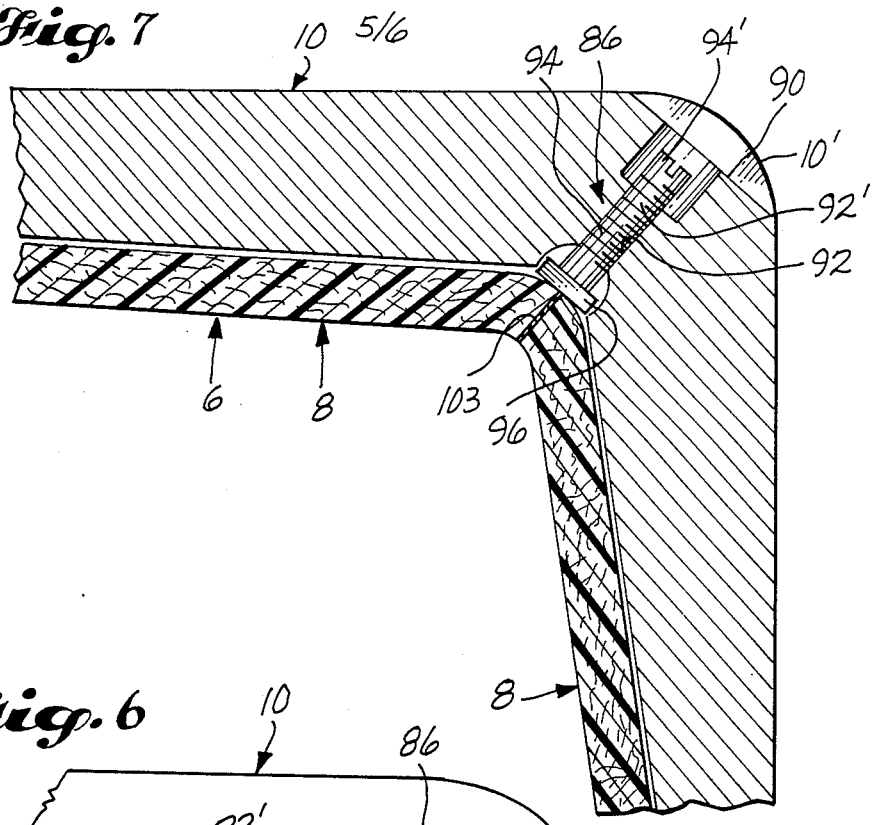
FIG. 7 a part cross-sectional view of the mold along 7—7 of FIG. 4.
Figure 6:
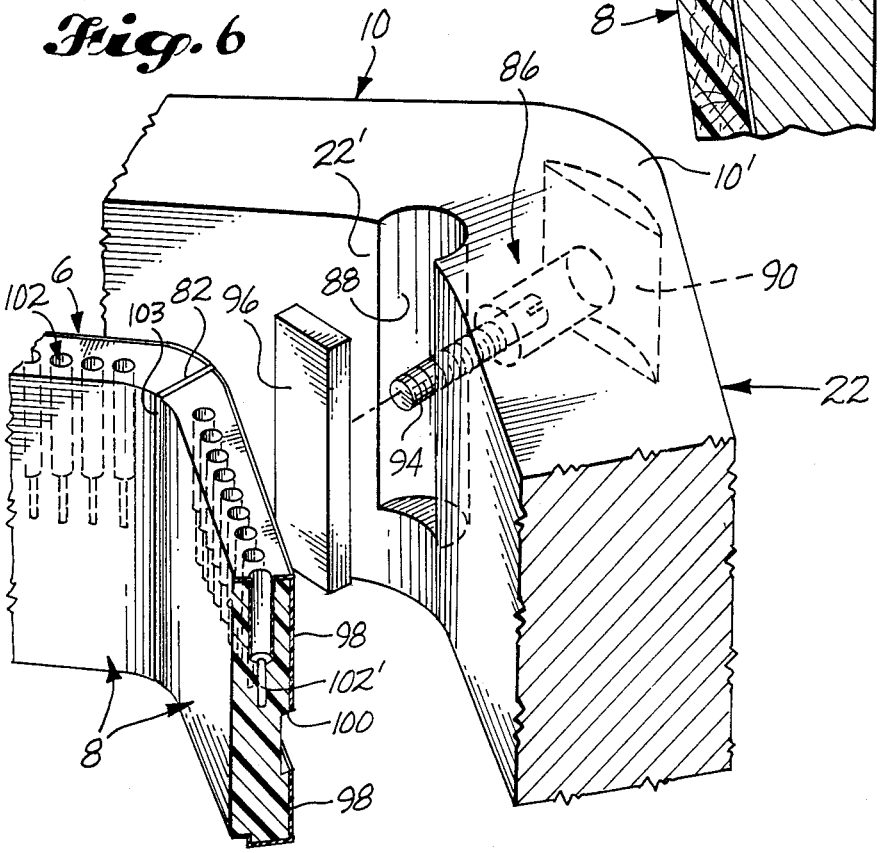
FIG. 6 is a part exploded view of the corner, illustrating the means employed in clamping together the pieces of the casting ring.

Referring to the drawings, it will be seen that the body 2 of the mold is generally rectangular in plan view, and constructed from a plurality of individually monolithic casing rings 26,20,22,14 and 16 which are of the same shape and stacked on top of one another about a common vertical axis 4. The three bottommost casing rings 26,20,22 form a liquid-coolant jacket 12 for the mold, as well as the supporting case 10 for a multi-piece casting ring 6 which is fabricated in situ on the mold from four elongated wall segments 8 that interconnect with one another to form the ring. The segments are rectangular in cross-section, horizontally thin, and generally rectilinear in length, so that when interconnected with one another, the ring 6 has a thin cookie-cutter-like appearance, axially of the mold. The segments 8 are assembled as individually discrete sides of the ring, and are clamped together, sash-like, in a manner to be explained. In addition, when they are clamped together to form the ring, the ring 6 is clamped in turn between the case 10 and the next superior casing ring 14, which is relatively reciprocably arranged about the axis 4 with the case to form an annular joint between the respective end openings of the mold, as shall be explained. The ring 14 is in the form of an annular plate, and in addition to serving as a clamp for the ring, it also serves as a base for a refractory hot top 16 which is superposed on top of the plate. The aperture 58 of the plate 14 has a diameter smaller than the diameter of the aperture 9 in the casting ring, so that the inner peripheral edge of the aperture in the plate forms an overhang for the hot top, relatively over the inner peripheral surface 9 of the ring. The aperture 74 in the hot top is still smaller in diameter, however, so that there is provision for the addition of a refractory scupper 18 at the inner periphery of the plate, as shall be explained.

More specifically, the casing rings 20,22 are sizeable stainless steel rings and form the main body of the case. The relatively lower casing ring 20 has an annular groove 24 about the underside thereof, and the groove 24 is sufficiently broad and deep to form the chamber 25 of the jacket 12. The chamber is covered in turn by an annular plate 26 which is also made of stainless steel and machine screwed to the bottom of the ring 20. The plate 26 has a hole 28 in the midsection thereof, through which liquid coolant is supplied to the chamber.

At its top, the relatively lower casing ring 20 is slightly rabbetted so as to have a raised bench 30 about the outer peripheral edge thereof, and a rounded corner 32 at the inner peripheral edge thereof. In addition, an annular groove 34 of semi-circular cross-section is formed in the flat 36 of the rabbet, at the inner peripheral flank of the bench 30, and holes 38 are also formed in the flat of the rabbet, at spaced intervals about the circumference of the ring.

The relatively upper casing ring 22 has a rectangular opening 39 at the inner periphery thereof, which is slightly smaller than that 40 of the lower ring 20, and the relatively upper ring 22 is rabbetted about the underside thereof to have a depending heel 41 about the outer peripheral edge thereof, and a depending lip 42 about the inner peripheral edge thereof. In addition, an annular groove 44 of semi-circular cross-section is formed in the flat 46 of the rabbet, at the inner peripheral flank of the heel; and the heel 40 and groove 44 are disposed on the relatively upper ring so that when the casing rings 20 and 22 are stacked on top of one another, the heel registers with the bench 30 of the relatively lower ring 20, and the grooves 34 and 44 of the respective rings register with one another, to enable the rings to be machine screwed together as shown, to define an annular slot 46 therebetween having a bore 48 of substantially circular cross-section at the outer periphery thereof. Meanwhile, the lip 42 on the upper ring and the rounded corner 32 of the lower ring, form a downwardly inclined chute 50 at the inner periphery of the slot 46, through which to discharge the liquid coolant that enters the slot through the holes 38 in the lower casing ring, at a radius just ahead of the bore 48 between the two rings.

At its top, the inner peripheral edge of the relatively upper casing ring 22 is deeply and widely rabbetted to form a seat for the wall segments 8 of the casting ring 6. The rabbet 52 is grooved at the bottom, moreover, to have a raised lip 54 about the inner peripheral edge thereof, and there is also a smaller groove 56 formed about the lip itself, in the bottom of the rabbet.

The plate 14 is also made of stainless steel and, as indicated, has a rectangular opening 58 that is still smaller than that of either the casting ring 6 or the case 10, so that the plate overhangs the casting ring at the inner periphery of the mold. The plate 14 also has a depending lip 60 about the overhang 62 thereof, and there are five grooves 64, 66, 68, 70 and 72 formed in the top and bottom of the plate, which extend fully about the same, circumferentially thereof. One groove, 64, is disposed in the top of the plate, relatively above the situs of the rabbet 52 in the case. The remaining four grooves 66, 68, 70 and 72 are disposed in the bottom of the plate, and three of them 66, 68 and 70, are arranged directly above the situs of the rabbet. The fourth 72 is spaced outwardly from the situs of the rabbet.

The hot top 16 is also annular and plate-like in construction, but fabricated from a refractory material, as indicated. The rectangular opening 74 in the hot top is still smaller than those of the case, the casting ring, and the plate 14, so that the hot top has a still further overhang 76 at the inner periphery 58 of the plate. The scupper 18 corresponds in size to the overhang 76 of the hot top, and has an outer peripheral flange 78 about its lower end, which corresponds in width to the overhang 62 of the plate. When the mold is fabricated, the plate 14 is machine screwed to the top of the case 10, as shown, and then the hot top 16 is bolted to the case through the plate, as shown. The scupper 18 is cemented, meanwhile, to the inner peripheral face 58 of the plate, and to the lip 60 of the plate. It is also cemented to the casting ring 6 at the top thereof, so that only the relatively bottom portion of the ring forms the casting surface 9 of the mold.

Before the plate 14 and hot top 16 are tightly secured to the case 10, the wall segments 8 of the casting ring 6 are seated in the rabbet 52 of the case, the plate 14 is loosely screwed onto the case, and the segments are clamped together to form the casting ring. The segments 8 are individually rabbetted at their lower inner peripheral edges, to seat behind the lip 54 of the case, and though each segment 80 is individually elongated, rectangular in cross-section, and basically rectilinear in length, it has a slight outward crook or bow 8' in the length of the same, as well as a slight inturn to the end portions 8'' thereof. The lips 60 and 54 of the plate 14 and the case 10 have a similar configuration, and the end portions 8'' of the segments are mitered at their opposing faces 80 to enable the segments to be tightly seized about the lips as their adjacent ends abut one another to form miter joints 82 between the mating faces 80 thereof. The joints 82 have rounded fillets 84 in turn, at the insides thereof, so that when the segments are clamped together, they form a smooth continuous casting surface 9 at the inner periphery of the mold. Moreover, when the plate 14 is tightly secured to the case thereafter, the segments 8 are tightly clamped between the overhang of the plate and the bottom of the rabbet 52, to secure the ring of the same against relative movement within the mold, both crosswise of the axis 4, and in planes parallel to the axis 4. The scupper 18, meanwhile, forms a tight rim around the top of the casting ring, at a level above that at which the molten metal tends to contact the ring.

The task of clamping the segments 8 together and seizing the ring 6 about the lips 60 and 54 of the plate and the case, is performed by a series of reciprocable clamping elements 86 in the corners 10' of the case, at the level of the rabbet 52 therein. As seen in FIGS. 4–7, in particular, there are part cylindrical alcoves 88 formed in the corners 22' of the upper casing ring 22, at the outer periphery of the rabbet. There are also sectors of the ring 22 removed at the outer peripheries of the corners 22', so that flats 90 are formed on the corners, substantially opposite the centers of the corresponding alcoves 88 therein. A hole 92 is removed from each corner, at the center of the corresponding flat 90, and the hole 92 is counterbored at the outside thereof, and threaded over the remaining inner peripheral portion 92' thereof. Each clamping element 86 comprises a set screw 94 which is threadedly engaged in the hole 92' of the corresponding corner 22' and accompanied by a small rectangular plate 96 which is seated in the alcove 88 of the corner, to abut the segments 8 of the casting ring 6 at the joint 82 thereopposite. When the segments are assembled in the rabbet 52, and abutted with one another about the lips 60 and 54, each screw 94 coincides with the interfacial plane of the adjacent joint 82, and through the medium of the accompanying plate 96, can be used to apply clamping pressure to the adjacent segments. Used together, moreover, the screws can be used to cinch up the entire assembly about the lips, and effectively seize the lips within the ring 6, as indicated. The effect can be conveniently accomplished with a screwdriver at the heads 94' of the screws in the counterbores 92'' of the holes 92 at the outside of the case, and as indicated, is normally accomplished only after the plate 14 has been loosely secured to the top of the case, above the segments, with its lip 60 depending inside of the same. Thereafter, when the casting ring 6 has been tightly seized about the lips 60, 54, and the plate 14 has been tightly secured to the case so as to clamp the ring 6 between the plate and the bottom of the rabbet 52, the hot top 16 is added to the top of the plate to complete the assembly.

One advantage of the invention, as explained earlier, is that a graphite or other fluid-permeable casting ring can be employed in the mold, and gas and oil can be forced through the ring to practice the process disclosed in U.S. Pat. No. 4,598,763. The ring and/or the mold must be adapted, however, to assure that the gas and oil discharge into the cavity of the mold only at the exposed inside casting surface 9 of the ring. Moreover, the metal should be cooled at a level below the ring, if possible, to follow the preferred practice of the patented process, and where a curtain of liquid coolant is employed at this level, to direct chill the metal as the body of the same emerges from the mold, preferably the coolant liquid is also infused with bubbles of insoluble gas in accordance with the process described in U.S. Pat. No. 4,693,298.

Referring again to the drawings herein, it will be seen that when segments 8 of graphite or other fluid-permeable material are used to practice the patented process, the longitudinal sides of each segment 8 are covered with a coating 98 of fluid-sealant material, with the exception of the inner peripheral face 9 of the segment, a part-annular groove 100 formed in the outer peripheral face of the same, and the bottom portions 102' of a series of longitudinally-spaced holes 102 formed in the top of the segment. In addition, the holes 102 are disposed in the respective segments to register with the center groove 68 of the three grooves 66, 68, 70 in the plate 14 above the rabbet 52 in the case, so that when the ring 6 is seized about the lips 60, 54 of the plate and the case, the center groove 68 can be used as a means for supplying oil to the tops 102'' of the holes 102 in the segments. Meanwhile, O-rings 104 of fluid-sealant material are used in the remaining grooves 66, 70, to seal off the groove 68; and additional O-rings 106 and 108 are used in the grooves 72 and 56 above and below the segments, to seal off the groove 100 from the inside and outside of the mold at the top and bottom of the ring 6.

To seal the joints 82 themselves, a pad 103 of flexible fluid-sealant gasket material is interposed between each pair of segments, at the joint 82 therebetween, but the respective pads have cut-outs therein (not shown) which provide continuity among the grooves 100 at the outer peripheral faces of the segments.

Gas and oil are supplied to the respective grooves 100 and 68 of the casting ring 6 by a pair of passages 110 and 112 in the upper casing ring 22 and the plate 14, respectively. The passage 110 is directly opposed to the groove 100 in the outer peripheral face of one segment 8, and is tapped at the outside end thereof, so as to have a threaded socket 114 to receive the threaded fitting (not shown) of a tube for supplying air or other gas to the grooves 100. The gas spreads through the respective grooves, which, as indicated, are circumferentially aligned with one another about the ring 6, and is forced into the segments 8 for discharge into the cavity of the ring 6 at points on the inner peripheral surface 9 thereof, and preferably opposite the intermediate continuum of the molten metal body, as explained in U.S. Pat. No. 4,598,763. The passage 112 to the holes 102 is angled across the plate 14 to a point above the groove 68, and again, is tapped to have a threaded socket 116 at the outside end thereof for the attachment of an oil supply tube (not shown) to the passage. The oil is forced into the bodies of the segments only through the bottoms 102' of the holes 102, however, since the tops 102'' of the holes are counterbored and coated with the sealant material 98, as seen in FIG. 3. In this way, the oil is caused to discharge with the gas so that it assists the molten metal body in slipping readily out of the mold without galling, as explained in U.S. Pat. No. 4,598,763.

To carry out the process disclosed in U.S. Pat. No. 4,693,298, the bore 48 in the case 10 between the casing rings 20 and 22, is equipped with a perforated tube 118, the perforations 120 of which discharge at the inner periphery thereof so as to bubble gas into the slot 46 just behind the holes 38 through which the liquid coolant enters the slot from the jacket 12 of the mold. The tube 118 is supplied with gas by an additional passage 122 in the upper casing ring 22, which is again tapped at the outside end 124 of the same to receive a supply tube (not shown) for the gas. The passage 122 is interconnected with the tube 118 through an opening (not shown) in the latter tube, that is surrounded by a grommet of sealant material, also not shown. As in the patented process, an insoluble gas is supplied to the passage, and infuses the liquid flow with discrete bubbles of the same that exit with the flow through the mouth 50 of the slot for the effects explained in U.S. Pat. No. 4,693,298.

Figure 8:
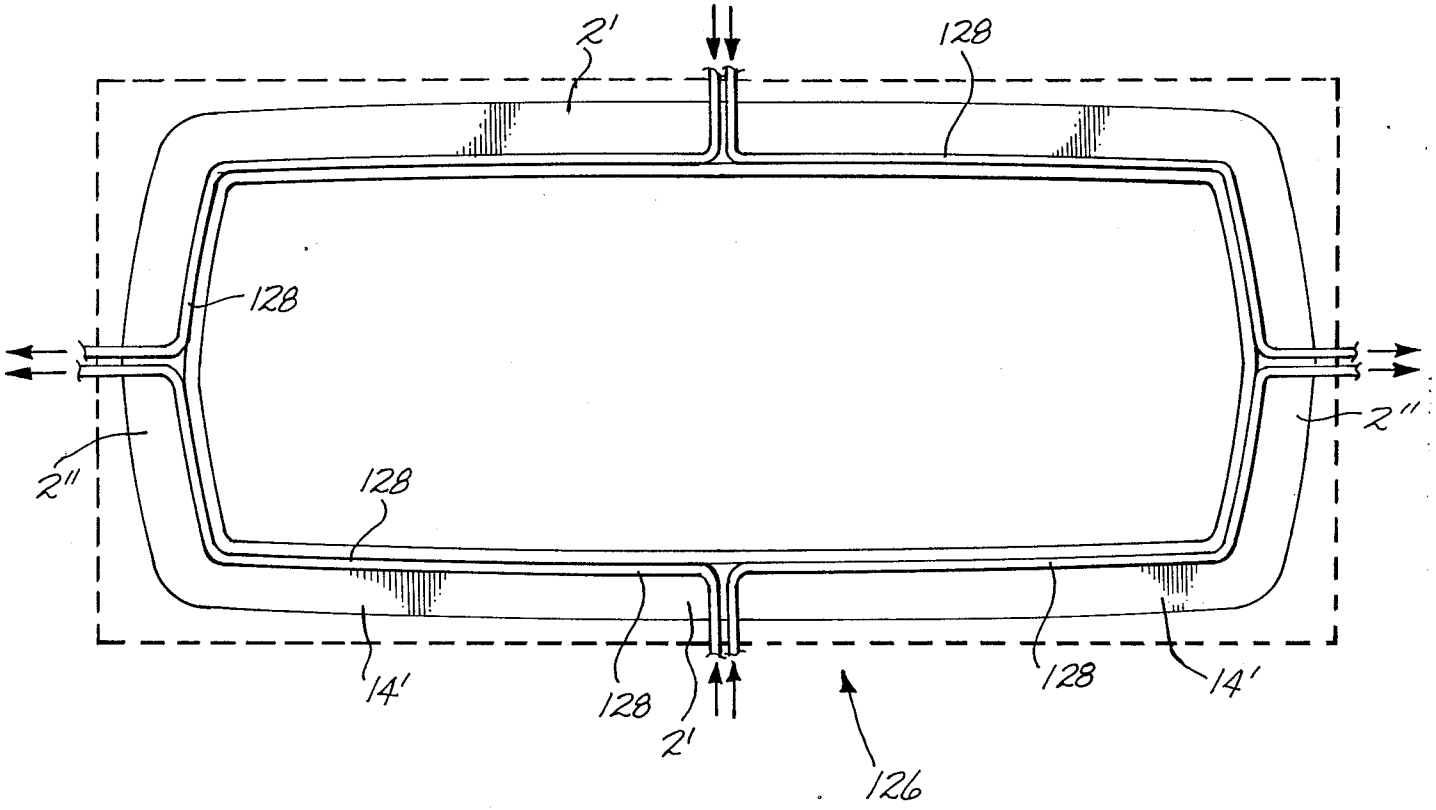
FIG. 8 is a schematic representation of the liquid coolant flow system employed in cooling the top of the mold.

Liquid coolant is supplied to the top of the mold 2 adjacent the O-rings 104 and 106, through a system 126 of tubes 128 that are installed in the groove 64 of the plate 14. Referring to FIG. 8, it will be seen that each end section 14' of the plate has a pair of tubes 128 installed in the groove 64 of the same, and each pair of tubes enters the mold midway of the opposing longitudinal sides 2' of the same. The pairs then exit at the opposing ends 2'' of the mold, and in this way assure that the coolant will have a balanced cooling effect on the sides 2' of the mold, as well as the ends 2'' of the mold, where it will have a lesser cooling effect because it will have undergone considerable heat-up in the sides beforehand.

The use of a stainless steel mold 2 minimizes cooling of the molten metal body as it passes through the mold, axially thereof. Moreover, the fact of cooling the mold at the top and bottom thereof, but not at the level of the casting surface 9, also minimizes cooling of the molten metal as it passes through the mold. Present practice is to minimize heat extraction from the molten metal body as it passes through the mold, and sometimes this end is even reinforced by preheating the gas supply for the casting ring 6 with an electric resistance heating coil (not shown), or the like, which is installed in the upper casing ring 22 at the level of the rabbet 52, so as to increase the temperature of the gas sleeve formed about the molten metal body.

The use of a multi-piece casting ring 6 makes it possible to isolate the ring in fluid-type manner, as shown, when the sleeve-forming technique of U.S. Pat. No. 4,598,763 is used. That is, the grooves 100 and 68 can be sealed off from one another at the axial ends of the ring, as shown, while gas and oil are fed to the grooves and forced through the ring 6 into the cavity of the mold at the casting surface 9 of the ring. The use of an "envelope" of sealant 98 about the ring 6, and flexible sealant pads 103 between the segments 8 of the ring, makes it possible to control the ingress and egress of fluids Into the ring 6 at groove 100 and holes 102, and out of the ring at surface 9, when the ring is clamped, as shown, between the plate 14 and the casing ring 22 of the case 10. Meanwhile, the O-rings 104, 106 and 108 serve as a means for enhancing the seal across the top and bottom of the ring, relatively radially inside and outside of the mold.

The coating material 98 is preferably a silicone resin coating material such as SR 17M, a silicone electrical insulating/impregnating varnish which is purchasable from the General Electric Company of Schenectady, N.Y., and brushed or otherwise applied to the surfaces of the ring segments 8 and then fired to leave a residual of the resin when the liquid carrier for the same is driven off. The gasket material used in making up the pads 103 is preferably GRAFOIL, a flexible graphite sheet material made by Union Carbide Corporation of Danbury, Conn.

The scupper 18 can be cemented to the plate 14 and to the casting ring 6, using conventional silicone rubber cement, such as the high temperature silicone rubber cement made by Dow Corning Company of Midland, Mich. The scupper is commonly installed in the mold only after the plate 14 has been tightly secured to the case 10, but before the hot top 16 is added to the top of the plate.

We claim:

1. In the process of forming the cavity of an open ended mold which is to be used in casting metal by the step of feeding the metal in molten condition through the mold along an axis extending between the end openings thereof, the step of configuring the cross sectional area of the cavity at the peripheral wall thereof by:

arranging a casting ring about the axis of the mold at a point between the end openings thereof, and clamping the ring within a pair of annular clamping devices at the peripheral wall of the cavity, to secure the ring axially and transversely thereof, respectively, the ring comprising a plurality of individually discrete pieces which interconnect with one another to form the ring and which are arranged in a plane extending perpendicular to the axis of the mold, and the pieces being clamped together within the ambit of one clamping device before the ring is clamped within the other clamping device, axially of the cavity.

2. The process according to claim 1 wherein one clamping device is applied about the outer peripheral face of the ring while it is disposed on an annular support adjacent the peripheral wall of the cavity, and the other clamping device is applied to the axial ends of the ring while it is secured within the one clamping device.

3. The process according the claim 2 wherein the clamping devices are applied to the ring while it is disposed in an annular recess at the peripheral wall of the cavity.

4. The process according to claim 3 wherein the annular recess is defined by the aforesaid other clamping device.

5. The process according to claim 2 wherein the mold comprises a pair of annular casing members which are relatively reciprocably arranged about the axis to form an annular joint between the respective end openings of the mold, and the casting ring is clamped between the casing members at the inner peripheral surface of the joint when the casting ring has been clamped within the one clamping device and the casing members have been reciprocated relatively toward one another to form the joint.

6. The process according to claim 5 wherein the casing members have an annular recess therebetween, the recess has a pair of spaced, axially-opposing lips at the inner periphery thereof, and the casting ring is arranged in the recess about the lips and clamped therebetween.

7. The process according to claim 1 wherein the pieces of the ring form an aperture having an angulated cross-sectional outline at the inner peripheral surface of the ring.

8. The process according to claim 1 wherein the body of the casting ring is fluid-permeable, and fluid delivery means are provided for forcing a fluid through the body of the ring for discharge into the cavity at the inner periphery of the ring.

9. In the process of casting metal ingot by the step of feeding the metal in molten condition through an open ended mold cavity having a peripheral wall formed about an axis extending between the end openings thereof, the further steps of:

arranging a plurality of individually discrete wall-defining members adjacent the peripheral wall of the cavity, interconnecting the walldefining members with one another to form a casting ring, the aperture of which has an angulated cross sectional outline at the inner peripheral surface of the ring, the wall-defining members being interconnected with one another by clamping them together on an annular support which is formed about the axis adjacent the peripheral wall of the cavity in a plane extending perpendicular to the axis, and securing the ring about the axis in the aforesaid plane so that when the molten metal transmigrates through the cavity along the axis, the ring confers an angulated cross sectional outline on the molten metal mass corresponding to that at the inner peripheral surface of the ring.

10. The process according the claim 9 wherein an annular lip is formed about the support at the inner periphery thereof, and the wall-defining members are arranged about the lip and clamped together so as to seize the lip as they come together to form the ring.

11. The process according to claim 9 wherein the mold comprises a pair of casing members which are clamped together about the axis to define the cavity, and the ring is clamped between the casing members at an annular recess defined therebetween.

12. The process according to claim 9 wherein the bodies of the wall-defining members are fluid-permeable, and fluid delivery means are provided for forcing a fluid through the body of the ring for discharge into the cavity at the inner periphery of the ring.

13. In an open ended mold for casting metal, the cavity of which has a peripheral wall formed about the axis extending between the end openings of the mold, a plurality of individually discrete wall-defining members assembled adjacent the peripheral wall of the cavity, means including a clamping device arranged about the outer periphery of the assembly of wall-defining members, externally thereof, to clamp the members together and form a casting ring, the aperture of which has an angulated cross sectional outline at the inner peripheral surface of the ring, and means for securing the ring about the axis in a plane extending perpendicular thereto, so that when a mass of molten metal is fed through the cavity along the axis, the ring confers an angulated cross sectional outline on the molten metal mass corresponding to that at the inner peripheral surface of the ring.

14. In an open ended mold which is to be used in casting metal by the step of feeding the metal in molten condition through the mold along an axis extending between the end openings thereof, a case arranged about the axis of the mold and having a generally rectangular opening in the body thereof, and an annular rabbet about the peripheral edge of the opening at one axial end thereof, and a set of spaced clamping elements which are movably mounted on the body of the case at points spaced about the outer periphery of the rabbet substantially externally thereof, and operable to apply clamping forces transverse the opening in the plane of the rabbet, so that they can be used to clamp a ring which is disposed on the rabbet, within the ambit of the set of clamping elements, to form the casting surface of the mold at the case.

15. The open ended mold according to claim 14 wherein the clamping elements include screws which are threadedly mounted in the body of the case adjacent the corners of the rabbet.

16. In an open ended mold which is to be used in casting metal by the step of feeding the metal in molten condition through the mold along an axis extending between the end openings thereof, means for forming the cavity of the mold comprising:

a pair of annular casing members which are relatively reciprocally arranged about the axis to form an annular joint between the respective end openings of the mold, and a casting ring which is arranged about the axis between the casing members and clampable between the casing members at the axial ends thereof to form the cavity at the inner peripheral surface of the joint when the casing members are reciprocated relatively toward one another to form the joint, there being an annular support between the casing members having an axially extending annular lip upstanding about the inner periphery thereof, and the casting ring being arranged on the support about the lip.

17. The open ended mold according to claim 16 wherein the support is formed by a recess in one of the casing members.

18. In an open ended mold which is to be used in casting metal by the step of feeding the metal in molten condition through the mold along an axis extending between the end openings thereof, means for forming the cavity of the mold comprising:

a pair of annular casing members which are relatively reciprocally arranged about the axis to form an annular joint between the respective end openings of the mold, and a casting ring which is arranged about the axis between the casing members and clampable between the casing members at the axial ends thereof to form the cavity at the inner peripheral surface of the joint when the casing members are reciprocated relatively toward one another to form the joint, there being an annular recess between the casing members having a pair of spaced, axially opposing lips at the inner periphery thereof, and the casting ring being arranged in the recess about the lips, to be clamped therebetween.

19. The open ended mold according to claim 18 wherein the recess is formed in one of the casing members.

20. In an open ended mold which is to be used in casting metal by the step of feeding the metal in molten condition through the mold along an axis extending between the end openings thereof, means for forming the cavity of the mold comprising:

a pair of annular casing members which are relatively reciprocally arranged about the axis to form an annular joint between the respective end openings of the mold, a casting ring which is arranged about the axis between the casing members and clampable between the casing members at the axial ends thereof to form the cavity at the inner peripheral surface of the joint when the casing members are reciprocated relatively toward one another to form the joint, the casting ring comprising a plurality of individually discrete pieces which interconnect with one another to form the ring, the pieces being arranged in a plane extending perpendicular to the axis of the mold, and there being a set of clamping devices which are arranged about the pieces, and relatively reciprocable in the plane of the pieces to clamp the pieces together and form the ring.

21. The open-ended mold according to claim 20 wherein the pieces are arranged on an annular support between the casing members, and the clamping devices are applied to the plurality of pieces from the body of one of the casing members.

22. The open-ended mold according to claim 21 wherein the support is formed by a recess in the one casing member.

23. The open-ended mold according to claim 21 wherein the support has an annular lip about the inner periphery thereof, and the pieces of the ring are clamped about the lip when they are interconnected with one another to form the ring.

24. The open-ended mold according to claim 20 wherein the casing members have an annular recess therebetween, the recess has a pair of spaced, axially-opposing lips at the inner periphery thereof, and the pieces of the ring are arranged in the recess and clamped about the lips in the space therebetween, when the pieces are interconnected with one another to form the ring.

25. The open ended mold according to claim 20 wherein the pieces are arranged to have relatively adjacent end portions in the plane of the ring, and sides thereof which abut one another in the ring, and wherein the clamping devices are applied to the plurality of pieces to abut them with one another at the aforesaid sides of their relatively adjacent end portions.

26. The open ended mold according to claim 25 wherein the relatively adjacent end portions of the pieces are mitered to abut at adjacent sides thereof, and the clamping devices are applied to the pieces at the joints between the mitered sides of the relatively adjacent end portions thereof, and along the planes of the joints, relatively radially inwardly of the aperture of the ring.

27. The open-ended mold according to claim 20 wherein the pieces of the ring form an aperture having an angulated cross-sectional outline at the inner peripheral surface of the ring.

28. The open-ended mold according to claim 20 wherein the pieces are four in number, individually elongated, and generally rectilinear in length, so that they form an aperture, the cross-sectional outline of which has a quadrilateral configuration at the inner peripheral surface of the ring.

29. In an open ended mold which is to be used in casting metal by the step of feeding the metal in molten condition through the mold along an axis extending between the end openings thereof, and wherein during the molding operation, the body of molten metal is fed along the axis from one end opening of the mold to the other, means for forming the cavity of the mold comprising:

a pair of first and second annular casing members which are relatively reciprocally arranged about the axis to form an annular joint between the respective end openings of the mold, and a casting ring which is arranged about the axis between the casing members and clampable between the casing members at the axial ends thereof to form the cavity at the inner peripheral surface of the joint when the casing members are reciprocated relatively toward one another to form the joint, the first casing member being disposed adjacent the aforesaid one end opening of the mold and the mold further comprising means for introducing liquid coolant into the first casing member at one pair of opposing sides thereof, and discharging the coolant at another pair of opposing sides thereof, so that the cooling effect on the first casing member is balanced between each pair of sides.

30. A casting ring for use in forming the cavity of an open ended mold which is to be used in casting metal ingot of angulated cross sectional outline, comprising:

a plurality of individually discrete pieces of wall-defining material which are assembled in a common plane so that they have pairs of relatively adjacent ends in the plane thereof, and which are adapted so that sides thereof abut one another adjacent said pairs of ends, to form a ring, the aperture of which has an angulated cross sectional outline at the inner peripheral surface of the ring.

31. The casting ring according to claim 30 wherein the relatively adjacent end portions of the pieces are mitered at adjacent sides thereof, so that the pieces can be clamped together to form a ring having mitered joints between pieces.

32. The casting ring according to claim 30 wherein the pieces are four in number, individually elongated, and generally rectilinear in length, so that they form an aperture, the cross-sectional outline of which has a quadrilateral configuration at the inner peripheral surface of the

33. The casting ring according to claim 30 wherein the bodies of the pieces are fluid-permeable and are adapted so that when abutted together to form the ring, the ring has an annular slot about the outer peripheral face thereof, a series of circumferentially spaced holes in one axial end thereof, and a layer of fluid-sealant material on the outer peripheral face thereof and the respective axial ends thereof, with the exception of the slot and the holes.

34. The casting ring according to claim 30 further comprising layers of fluid-sealant material to be interposed between the pieces, at the joints therebetween.

35. In an open-ended mold for casting metal of angulated cross-sectional outline, a wall-defining member for use in forming a casting ring comprising:

an elongated piece of wall-defining material which is generally rectilinear in length and quadrilateral in cross section transverse its length, and which has surfaces on one longitudinally extending side thereof, adjacent the opposing ends of said one side, which are mitered relatively toward one another in the direction of the central cross sectional plane of the piece, transverse the length thereof.

36. The wall-defining member according to claim 35 wherein the body of the piece is fluid-permeable, and has a slot along the length of the side thereof opposed to the aforesaid one longitudinally extending side thereof, and a series of longitudinally spaced holes in one of the remaining longitudinally extending sides thereof, and a layer of fluid-sealant material on each of the longitudinally extending sides thereof, with the exception of the surfaces of the slot and the holes, and a portion of the surface of the aforesaid one longitudinally extending side thereof.

37. The wall-defining member according to claim 36 wherein the holes are counterbored and the counterbores of the same also have a layer of fluid-sealant material thereon.

38. The wall-defining member according to claim 35 wherein the body of the piece has a bow in the length of the same, relatively toward the side thereof opposed to the aforesaid one longitudinally extending side thereof.

39. In the process of forming the cavity of an open ended mold which is to be used in casting metal by the step of feeding the metal in molten condition through the mold along an axis extending between the end openings thereof, the steps of:

assembling a plurality of individually discrete pieces of wall-defining material about the axis of the mold at a point between the end openings thereof so that the pieces form a ring of said material which is disposed in a plane extending perpendicular to the axis, applying forces to the pieces in said plane at the outer periphery of the assembly to clamp the pieces together in said ring, and clamping the ring between a pair of annular casing members which are relatively reciprocally opposed to one another about the axis and interengageable with the axial ends of the ring to form an annular joint between the respective end openings of the mold which defines the cavity of the mold at the inner peripheral surface thereof.

40. The process according to claim 39 wherein the pieces are assembled on an annular support between the casing members and the clamping forces are applied to the pieces from the joint.

41. The process according to claim 40 wherein the support is formed by a recess in one of the casing members.

42. The process according to claim 41 wherein the support has an annular lip about the inner periphery thereof, and the pieces are clamped together about the lip.

43. The process according to claim 39 wherein the casing members having an annular recess therebetween, the recess has a pair of spaced, axially opposing lips about the inner periphery thereof, and the pieces are assembled in the recess and clamped together about the lips, in the space therebetween.

44. The process according to claim 39 wherein a set of clamping devices is incorporated in the mold about the outer periphery of the assembly of pieces, and the devices are relatively reciprocated in the plane of the ring to clamp the pieces together as a ring.

45. The process according to claim 39 wherein the pieces are assembled so that they have pairs of relatively adjacent end portions, and sides thereof which abut one another in the ring.

46. The process according to claim 45 wherein the relatively adjacent end portions of the pieces are mitered at adjacent sides thereof, and the clamping forces are applied to the pieces to abut them together at the mitered sides of their relatively adjacent end portions.

47. The process according to claim 39 wherein the pieces form an aperture, the cross sectional outline of which has an angulated configuration at the inner peripheral surface of the ring.

48. The process according to claim 39 wherein the pieces are four in number, individually elongated, and generally rectilinear in length, so that they form an aperture, the cross sectional outline of which has a quadrilateral configuration at the inner peripheral surface of the ring.

49. In the cavity of an open ended mold which is to be used in casting metal by the step of feeding the metal in molten condition through the mold along an axis extending between the end openings thereof, a casting ring arranged about the axis of the mold at a point between the end openings thereof, and pair of annular clamping devices which are disposed adjacent the peripheral wall of the cavity to secure the ring axially and transversely thereof, respectively, the ring comprising a plurality of individually discrete pieces which interconnect with one another to form the ring and which are arranged in a plane extending perpendicular to the axis of the mold, and the pieces being clamped together within the ambit of one clamping device to configure the cross sectional area of the cavity at the peripheral wall thereof, and clamped within the other clamping device, axially of the cavity, to secure them axially of the cavity.

50. In the cavity of an open ended mold for casting metal ingot by the step of feeding the metal in molten condition through the cavity along an axis extending between the end openings of the mold, an annular support which is formed about the axis adjacent the peripheral wall of the cavity in a plane extending perpendicular to the axis, a plurality of individually discrete wall-defining members which are clamped together on the support to form a casting ring, the aperture of which has an angulated cross sectional outline at the inner peripheral surface of the ring, and means securing the ring about the axis in the aforesaid plane so that when the molten metal transmigrates through the cavity along the axis, the ring confers an angulated cross sectional outline on the molten metal mass corresponding to that at the inner peripheral surface of the ring.

51. In the process of forming the cavity of an open ended mold which is to be used in casting metal by the steps of feeding a body of metal in molten condition through the mold along an axis extending between the end openings thereof while the molten metal body is enveloped in an oil-encompassed annulus of gas, the steps of:

assembly in a plurality of individually discrete pieces of fluid permeable material about the axis of the mold at a point between the end openings thereof so that the pieces form a ring of said material which is disposed in a plane extending perpendicular to the axis, applying forces to the pieces in said plane at the outer periphery of the assembly to clamp the pieces together in said ring, clamping the ring between a pair of first and second annular casing members which are relatively reciprocally opposed to one another about the axis and interengageable with the axial ends of the ring to form an annular joint between the respective end openings of the mold which defines the cavity of the mold at the inner peripheral surface thereof, and incorporating fluid delivery means in the mold about the ring for use in forcing a fluid through the body of the ring to form the annulus of gas at the inner peripheral surface of the joint when the molten metal body is fed through the mold.

52. The process according to claim 51 wherein the pieces are assembled on an annular support between the casing members and the clamping forces are applied to the pieces from the joint.

53. The process according to claim 52 wherein the support is formed by a recess in one of the casing members.

54. The process according to claim 52 wherein the support has an annular lip about the inner periphery thereof, and the pieces are clamped together about the lip.

55. The process according to claim 51 wherein the casing members have an annular recess therebetween, the recess has a pair of spaced, axially opposing lips about the inner periphery thereof, and the pieces are assembled in the recess and clamped together about the lips, in the space there between.

56. The process according to claim 51 wherein during the molding operation, the body of molten metal is fed along the axis from one end opening of the mold to the other, and wherein the first casing member is disposed adjacent the aforesaid one end opening of the mold and given a diameter at the aperture thereof, which is smaller than the diameter of the aperture of the ring, so that the inner peripheral edge of the aperture in the first casing member forms an overhang for a hot top, relatively over the inner peripheral surface of the joint.

57. The process according to claim 51 wherein during the molding operation, the body of the molten metal is fed along the axis from one end opening of the mold to the other, and wherein the first casing member is disposed adjacent the aforesaid one end opening of the mold and means are incorporated in the mold for introducing liquid coolant into the first casing member at one pair of opposing sides thereof, and discharging the coolant at another pair of opposing sides thereof, so that the cooling effect on the first casing member is balanced between each pair of sides.

58. The process according to claim 51 wherein during the molding operation, the body of molten metal is fed along the axis from one end opening of the mold to the other, and wherein the second casing member is disposed adjacent the aforesaid other end opening of the mold and means are incorporated in the mold for introducing liquid coolant into the second casing member and discharging the coolant from the same onto the body of metal as the body emerges from the other end opening of the mold.

59. The process according to claim 58 wherein additional means are incorporated in the mold for infusing bubbles of insoluble gas into the coolant before it is discharged onto the metal body.

60. The process according to claim 51 wherein a layer of fluid sealant material is interposed between each of the axial ends of the ring and the adjacent casing member.

61. The process according to claim 60 wherein a layer fluid delivery means are adapted to force the fluid into the ring at an annular surface thereof about the outer periphery of the ring, and a layer of fluid sealant material is formed on the outer peripheral face of the ring between the aforesaid surface and each of the axial ends of the ring.

62. The process according to claim 60 wherein a series of circumferentially spaced ports is formed in the body of the ring which open through the layer of fluid sealant material at one axial end of the ring, and additional fluid delivery means are incorporated into the mold for use in forcing a second fluid through the body of the ring at the series of ports.

63. The process according to claim 51 wherein a set of clamping devices is incorporated in the mold about the outer periphery of the assembly of pieces, and the devices are relatively reciprocated in the plane of the ring to clamp the pieces together as a ring.

64. The process according to claim 63 wherein the pieces are assembled on an annular support between the casing members, and the clamping devices are applied to the assembly of pieces from the body of one of the casing members.

65. The process according to claim 64 wherein the support is formed by a recess in the one casing member.

66. The process according to claim 64 wherein the support has an annular lip about the inner periphery thereof, and the pieces are clamped together about the lip.

67. The process according to claim 63 wherein the casing members have an annular recess therebetween, the recess has a pair of spaced, axially opposing lips about the inner periphery thereof, and the pieces are assembled in the recess and clamped together about the lips, in the space therebetween.

68. The process according to claim 51 wherein the pieces are assembled so that they have pairs of relatively adjacent end portions, and sides thereof which abut one another in the ring.

69. The process according to claim 68 wherein the relatively adjacent end portions of the pieces are mitered at adjacent sides thereof, and the clamping forces are applied to the pieces to abut them together at the mitered sides of their relatively adjacent end portions.

70. The process according to claim 51 wherein the pieces form an aperture, the cross sectional outline of which has an angulated configuration at the inner peripheral surface of the ring.

71. The process according to claim 51 wherein the pieces are four in number, individually elongated, and generally rectilinear in length, so that they form an aperture, the cross sectional outline of which has a quadrilateral configuration at the inner peripheral surface of the ring.

72. In an open ended mold which is to be used in casting metal by the steps of feeding a body of the metal in molten condition through the mold along an axis extending between the end openings thereof while the molten metal body is enveloped in an oil-encompassed annulus of gas, a pair of first and second annular casing members which are relatively reciprocally opposed to one another about the axis to form an annular joint between the respective end openings of the mold, a plurality of individually discrete pieces of fluid permeable material which are assembled about the axis at a point between the casing members to form a ring of said material which is disposed in a plane extending perpendicular to the axis, and means disposed about the outer periphery of the assembly of pieces for clamping the pieces together as a ring in said plane.

said ring being clampable between the casing members at the axial ends thereof to form the cavity of the mold at the inner peripheral surface of the joint when the casing members are reciprocated relatively toward one another to form the joint, and said joint having fluid delivery means operatively incorporated therein about the ring for use in forcing a fluid through the body of the ring to form the annulus of gas at the inner peripheral surface of the joint when the molten metal body is fed through the mold.

73. The open ended mold according to claim 72 wherein the pieces are assembled on an annular support between the casing members and the clamping means are operable to apply the clamping forces to the pieces from the joint.

74. The open ended mold according to claim 73 wherein the support is formed by a recess in one of the casing members.

75. The open ended mold according to claim 73 wherein the support has an annular lip about the inner periphery thereof, and the clamping means are operable to clamp the pieces together about the lip.

76. The open ended mold according to claim 72 wherein the casing members have an annular recess there between, the recess has a pair of spaced, axially opposing lips about the inner periphery thereof, the pieces are assembled in the recess and the clamping means are operable to clamp the pieces together about the lips, in the space there between.

77. The open ended mold according to claim 72 wherein during the molding operation, the body of molten metal is fed along the axis from one end opening of the mold to the other, and wherein the first casing member is disposed adjacent the aforesaid one end opening of the mold and has a diameter at the aperture thereof, which is smaller than the diameter of the aperture of the ring, so that the inner peripheral edge of the aperture in the first casing member forms an overhang for a hot top, relatively over the inner peripheral surface of the joint.

78. The open ended mold according to claim 72 wherein during the molding operation, the body of the molten metal is fed along the axis from one end opening of the mold to the other, and wherein the first casing member is disposed adjacent the aforesaid one end opening of the mold and the mold further comprises means for introducing liquid coolant into the first casing member at one pair of opposing sides thereof, and discharging the coolant at another pair of opposing sides thereof, so that the cooling effect on the first casing member is balanced between each pair of sides.

79. The open ended mold according to claim 72 wherein during the molding operation, the body of molten metal is fed along the axis from one end opening of the mold to the other, and wherein the second casing member is disposed adjacent the aforesaid other end opening of the mold and the mold further comprises means for introducing liquid coolant into the second casing member and discharging the coolant from the same onto the body of metal as the body emerges from the other end opening of the mold.

80. The open ended mold according to claim 79 further comprising means for infusing bubbles of insoluble gas into the coolant before it is discharged onto the metal body.

81. The open ended mold according to claim 72 wherein a layer of fluid sealant material is interposed between each of the axial ends of the ring and the adjacent casing member.

82. The open ended mold according to claim 81 wherein the fluid delivery means are operable to force the fluid into the ring at an annular surface thereof about the outer periphery of the ring, and a layer of fluid sealant material is formed on the outer peripheral face of the ring between the aforesaid surface and each of the axial ends of the ring.

83. The open ended mold according to claim 81 wherein the pieces are adapted so that the body of the ring has a series of circumferentially spaced ports therein which open through the layer of fluid sealant material at one axial end of the ring, and the mold further comprises additional fluid delivery means for use in forcing a second fluid through the body of the ring at the series of ports.

84. The open ended mold according to claim 72 wherein the clamping means include a set of clamping devices which are disposed about the outer periphery of the assembly of pieces, and relatively reciprocable in the plane of the ring to clamp the pieces together as a ring.

85. The open ended mold according to claim 84 wherein the pieces are assembled on an annular support between the casing members, and the clamping devices are disposed to be applied to the assembly of pieces from the body of one of the casing members.

86. The open ended mold according to claim 85 wherein the support is formed by a recess in the one casing member.

87. The open ended mold according to claim 85 wherein the support has an annular lip about the inner periphery thereof, and the clamping devices are operable to clamp the pieces together about the lip.

88. The open ended mold according to claim 84 wherein the casing members have an annular recess there between, the recess has a pair of spaced, axially opposing lips about the inner periphery thereof, the pieces are assembled in the recess and the clamping devices are operable to clamp the pieces together about the lips, in the space therebetween.

89. The open ended mold according to claim 72 wherein the pieces have pairs of relatively adjacent end portions in the assembly of the same, and sides thereof which abut one another in the ring.

90. The open ended mold according to claim 89 wherein the relatively adjacent end portions of the pieces are mitered at adjacent sides thereof, and the clamping means are operable to abut the pieces together at the mitered sides of their relatively adjacent end portions.

91. The open ended mold according to claim 72 wherein the pieces form an aperture, the cross sectional outline of which has an angulated configuration at the inner peripheral surface of the ring.

92. The open ended mold according to claim 72 wherein the pieces are four in number, individually elongated, and generally rectilinear in length, so that they form an aperture, the cross sectional outline of which has a quadrilateral configuration at the inner peripheral surface of the ring.

93. In an open ended mold which is to be used in casting metal by the step of feeding the metal in molten condition through the mold along an axis extending between the end openings thereof, means for forming the cavity of the mold, comprising:

a pair of annular casing members which are relatively reciprocally arranged about the axis to form an annular joint between the respective end openings of the mold, a casting ring, the body of which is fluid permeable and defines an aperture, the cross sectional outline of which has an angulated configuration at the inner peripheral surface of the ring, and fluid delivery means for forcing a fluid through the body of the ring for discharge into the aperture thereof at the inner peripheral surface of the ring, the casting ring being arranged about the axis between the casing members and clampable between the casing members at the axial ends thereof to form the cavity of the mold at the inner peripheral surface of he joint when the casing members are reciprocated relatively toward one another to form the joint, and the fluid delivery means being disposed about the outer periphery of the body of the ring to force the fluid into the body at a surface thereof.

94. In an open ended mold which is to be used in casting metal by the step of feeding the metal in molten condition through the mold along an axis extending between the end openings thereof, means for forming the cavity of the mold comprising:

a pair of annular casing members which are relatively reciprocally arranged about the axis to form an annular joint between the respective end openings of the mold, and a casting ring which is arranged about the axis between the casing members and clampable between the casing members at the axial ends thereof to form the cavity at the inner peripheral surface of the joint when the casing members are reciprocated relatively toward one another to form the joint, the body of the casting ring being fluid permeable, and fluid delivery means being provided for forcing a fluid through the body of the ring for discharge into the cavity at the inner periphery of the ring, a layer of fluid-sealant material being interposed between each of the axial ends of the ring and the adjacent casing member, the fluid delivery means being adapted to force the fluid into the casting ring at an annular surface about the outer peripheral face of the ring, and the ring having a layer of fluid-sealant material formed on the outer peripheral face thereof, between the surface and each of the axial ends of the ring.

95. The open-ended mold according to claim 94 wherein the ring has a series of circumferentially spaced ports in the body thereof, which open through the layer of fluid-sealant material at one axial end of he ring, and second fluid delivery means are provided for forcing a second fluid through the body of the ring, at the ports, for discharge into the cavity with the first mentioned fluid at the inner periphery of the ring.

* * * * *

UNITED STATES PATENT AND TRADEMARK OFFICE

CERTIFICATE OF CORRECTION

PATENT NO. : 4,947,925

DATED : August 14, 1990

INVENTOR(S) : Wagstaff et al

It is certified that error appears in the above-identified patent and that said Letters Patent is hereby corrected as shown below:

Col. 18, claim 32, line 6, thereof, add "ring." to the end of the line.

Col. 20, claim 51, line 8, thereof, "assembly in" should be "assembling".

Col. 21, claim 61, line 1, thereof, "a layer" should be "the".

Col. 25, claim 93, line 21, thereof, "he" should be "the".

Col. 26, claim 95, line 4, thereof, "he" should be "the".

Signed and Sealed this

Second Day of March, 1993

*Attest:*

STEPHEN G. KUNIN

*Attesting Officer*

*Acting Commissioner of Patents and Trademarks*